US012722252B2

(12) United States Patent
Thionnet et al.

(10) Patent No.: US 12,722,252 B2
(45) Date of Patent: Sep. 1, 2026

(54) MACHINING TOOL FOR GRINDING A WORKPIECE

(71) Applicant: Comadur SA, Le Locle (CH)

(72) Inventors: Eric Thionnet, Le Russey (FR); Pierry Vuille, Les Emibois (CH)

(73) Assignee: Comadur SA, Le Locle (CH)

( * ) Notice: Subject to any disclaimer, the term of this patent is extended or adjusted under 35 U.S.C. 154(b) by 1672 days.

(21) Appl. No.: 16/458,403

(22) Filed: Jul. 1, 2019

(65) Prior Publication Data

US 2020/0047314 A1 Feb. 13, 2020

(30) Foreign Application Priority Data

Aug. 7, 2018 (EP) ..... 18187831

(51) Int. Cl.
*B24D 7/02* (2006.01)
*B24D 7/18* (2006.01)

(52) U.S. Cl.
CPC *B24D 7/02* (2013.01); *B24D 7/18* (2013.01)

(58) Field of Classification Search
CPC . B24D 7/06; B24D 7/066; B24D 7/14; B24D 7/16; B24D 7/02; B24D 7/18; B24D 5/16; B24D 5/14; B24D 5/06; B24B 45/003
USPC ..... 451/541, 548
See application file for complete search history.

(56) References Cited

U.S. PATENT DOCUMENTS 2,309,016 A * 1/1943 Ryan ..... B24D 7/14 451/548
2,451,295 A * 10/1948 Metzger ..... B24D 7/14 D15/126
2,496,352 A * 2/1950 Metzger ..... B24D 7/14 451/461
6,193,593 B1 * 2/2001 Miller ..... B24B 15/02 451/527
7,150,677 B2 * 12/2006 Yamashita ..... B24B 53/017 451/443
11,712,775 B2 * 8/2023 Tucker ..... B24B 41/067 451/41

(Continued)

FOREIGN PATENT DOCUMENTS

CH 685930 A5 * 11/1995 ..... B24B 9/06
CN 1265954 A * 9/2000

(Continued)

OTHER PUBLICATIONS

KR-20060002237-A espacenet (Year: 2024).*

(Continued)

*Primary Examiner* — Robert F Neibaur
(74) *Attorney, Agent, or Firm* — Oblon, McClelland, Maier & Neustadt, L.L.P.

(57) ABSTRACT

The machining tool is used for grinding a workpiece in a machine tool. The tool includes at least a first machining portion having particles of a harder material than the material of the workpiece to be machined, the particles being arranged in a binder, and at least a second machining portion having particles of smaller diameter than the first machining portion, and of a harder material than the material of the workpiece to be machined, the particles of the second portion being arranged in an identical binder to that of the first portion or in a different binder.

7 Claims, 16 Drawing Sheets

(56) References Cited

U.S. PATENT DOCUMENTS

| | | | | |
|---|---|---|---|---|
| 2006/0286907 | A1* | 12/2006 | Hwang | B24B 13/015 451/64 |
| 2012/0214388 | A1 | 8/2012 | Chen et al. | |
| 2014/0331838 | A1* | 11/2014 | Baker | B24B 3/46 451/529 |

FOREIGN PATENT DOCUMENTS

| | | | | | |
|---|---|---|---|---|---|
| CN | 1095726 | C | | 12/2002 | |
| CN | 101462243 | A | | 6/2009 | |
| CN | 203863544 | U | * | 10/2014 | |
| CN | 204525209 | U | * | 8/2015 | |
| CN | 101909822 | B | * | 2/2016 | B24B 45/003 |
| CN | 205888918 | U | | 1/2017 | |
| CN | 107738196 | A | * | 2/2018 | B24D 18/0009 |
| DE | 20302830 | U1 | * | 5/2003 | B24B 9/10 |
| FR | 2 994 871 | A1 | | 3/2014 | |
| JP | 4-223859 | A | | 8/1992 | |
| JP | 5-318325 | A | | 12/1993 | |
| JP | 2001062734 | A | * | 3/2001 | H01L 23/3171 |
| JP | 2001150307 | A | * | 6/2001 | |
| JP | 2009-125918 | A | | 6/2009 | |
| JP | 3171267 | U | | 10/2011 | |
| KR | 20060002237 | A | * | 1/2006 | |
| KR | 10-2017-0108221 | | | 9/2017 | |
| KR | 20170108219 | A | * | 9/2017 | B24B 9/06 |
| WO | WO 2012/084357 | A1 | | 6/2012 | |

OTHER PUBLICATIONS

CN-204525209-U espacenet (Year: 2024).*
CH-685930-A5 espacenet (Year: 2024).*
CN-107738196-A espacenet (Year: 2024).*
CN-1265954-A espacenet (Year: 2024).*
CN-101909822-B espacenet (Year: 2024).*
CN-203863544-U espacenet (Year: 2024).*
DE-20302830-U1 espacenet (Year: 2024).*
Machine translation of JP-2001062734-A (Year: 2001).*
Machine translation of KR-20170108219-A (Year: 2017).*
Machine translation of JP-2001150307-A (Year: 2001).*
European Search Report issued Jan. 18, 2019 in European Application18187831.5 filed Aug. 7, 2018 (with English Translation of Categories of Cited Documents).
Combined Chinese Office Action and Search Report issued Feb. 2, 2021 in Patent Application No. 201910721691.7 (with English language translation and English translation of Category of Cited Documents), 15 pages.
Office Action issued Mar. 9, 2021 in corresponding Japanese Patent Application No. 2019-137630 (with English Translation), 4 pages.
Korean Office Action issued on Aug. 11, 2020 in Patent Application No. 10-2019-0092138 (with English translation), 10 pages.

* cited by examiner

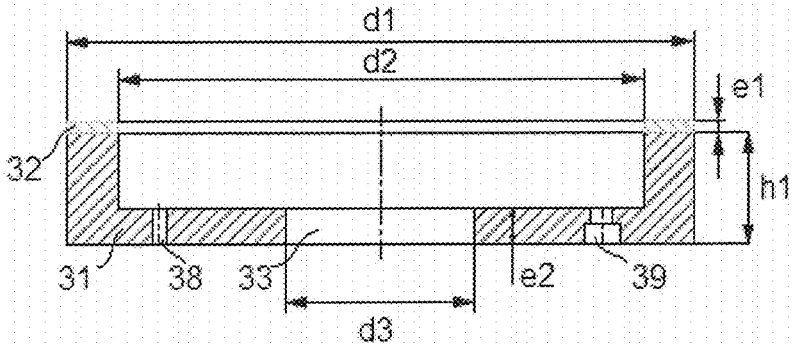
Fig. 3a
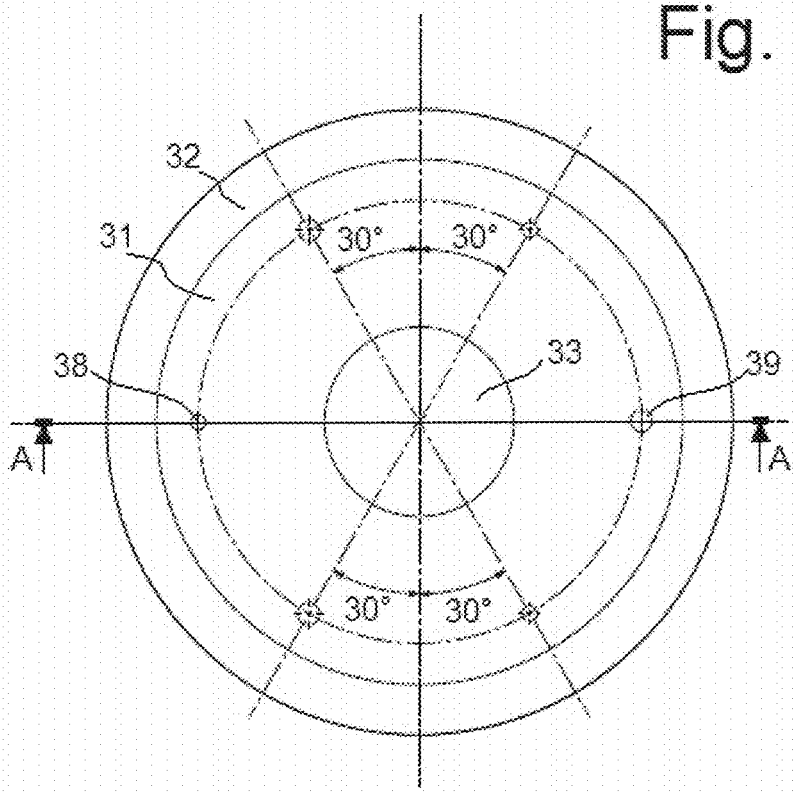

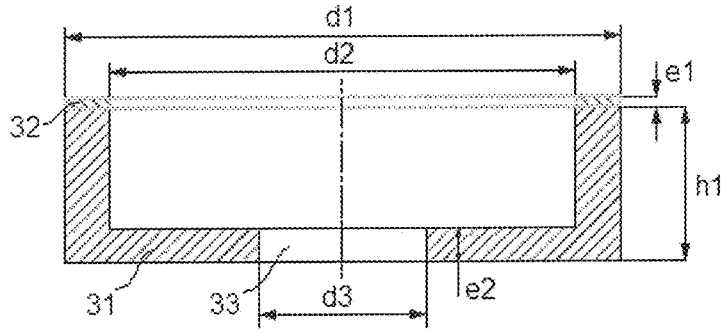
Fig. 4a
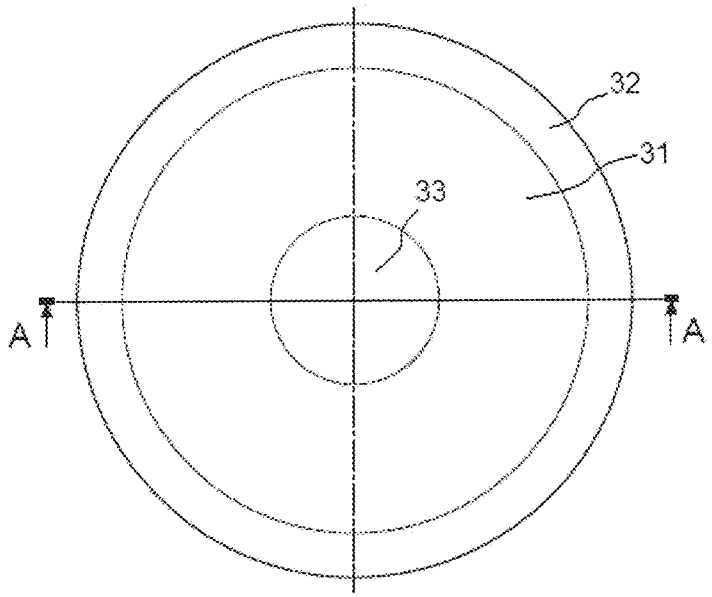

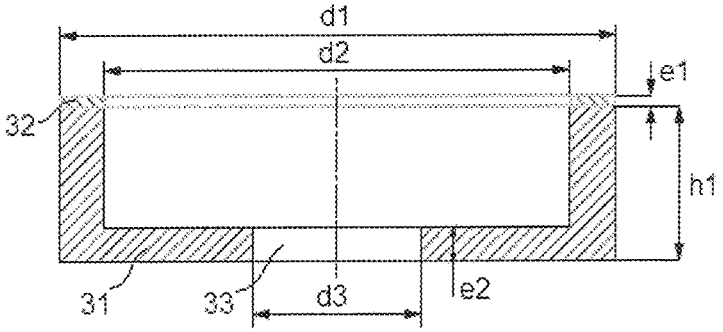
Fig. 5a
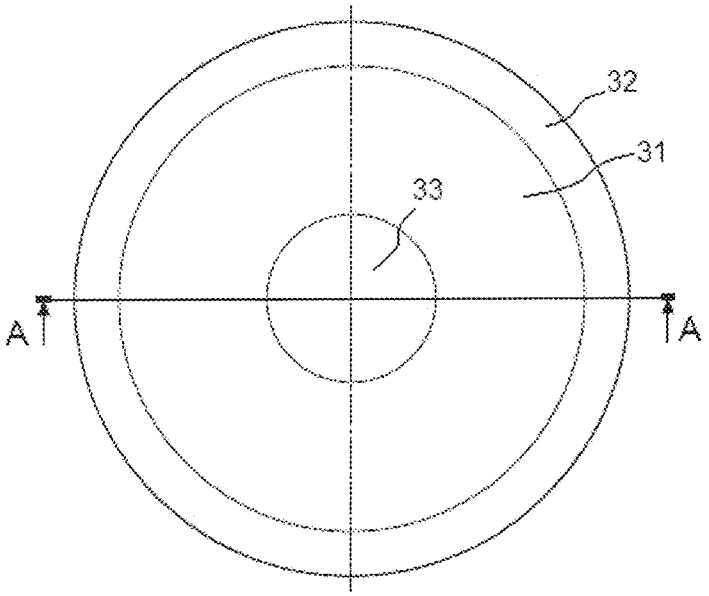

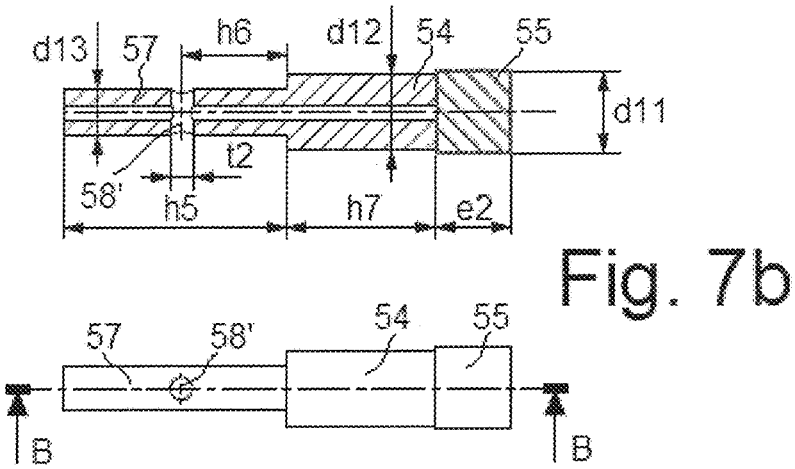
Fig. 7b
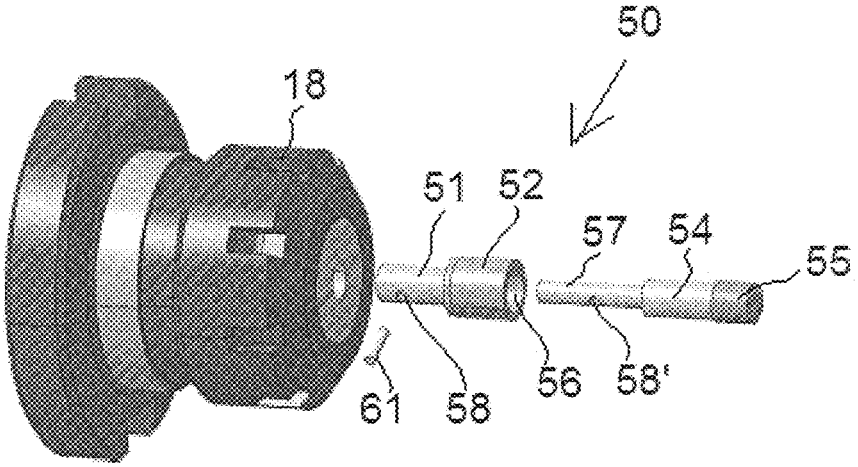
Fig. 7c
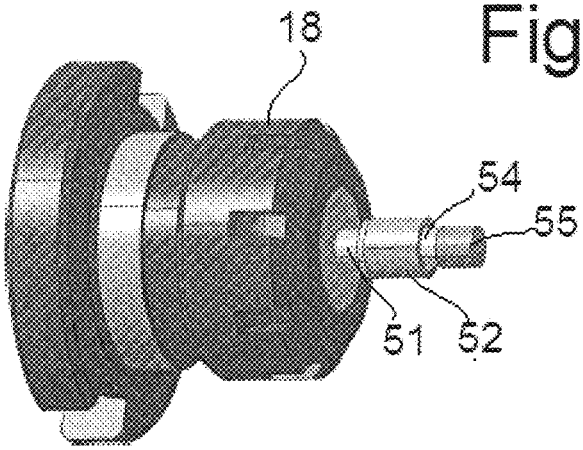

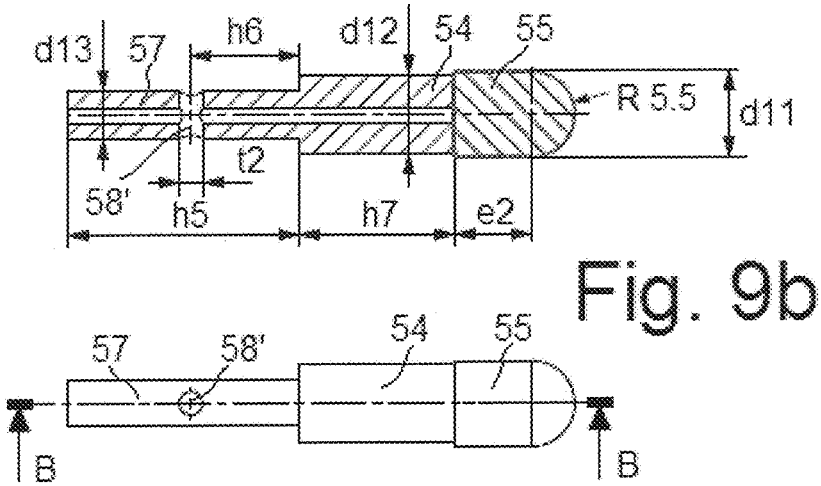
Fig. 9b
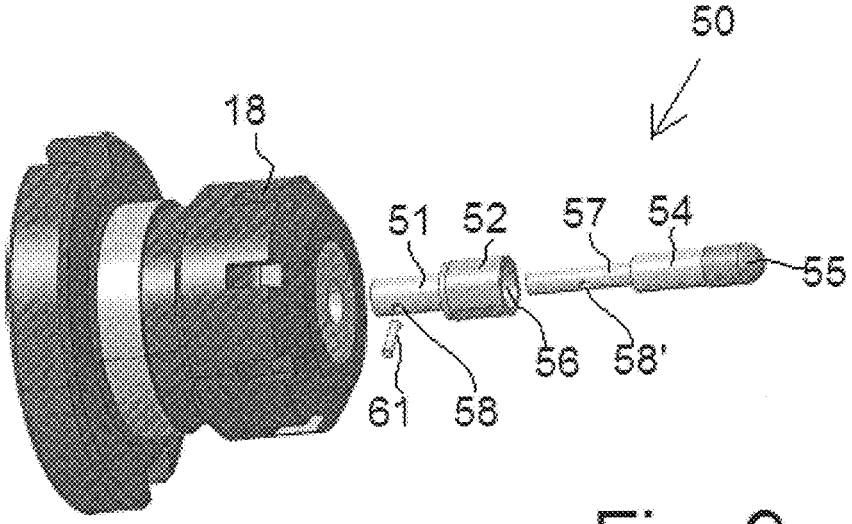
Fig. 9c
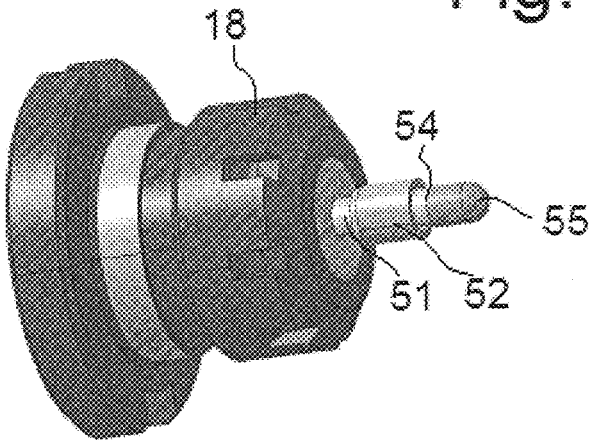

MACHINING TOOL FOR GRINDING A WORKPIECE

CROSS-REFERENCE TO RELATED APPLICATION

This application claims priority to European Patent Application No. 18187831.5 filed on Aug. 7, 2018, the entire disclosure of which is hereby incorporated herein by reference.

FIELD OF THE INVENTION

The invention concerns a machining tool for performing a grinding operation on a workpiece, particularly made of hard material, in a machine tool.

BACKGROUND OF THE INVENTION

For a grinding operation in a machine tool, it is known to change the machining tool between a rough grinding step and at least one finishing step by abrasive machining of the surface of workpieces to be machined. To grind a surface of a workpiece made of hard material, first of all, a first tool can be used with a machining band having, for example, large-diameter diamond particles in a binder—this is a rough grinding step. After this first step, a second tool can be used, with a machining band having smaller-diameter diamond particles than in the first step to form a semi-finishing step. Finally, a third tool can also be used with a machining band having diamond particles of even smaller diameter than in the second step for a final finishing step. In this case, three grinding tools must necessarily be used.

As mentioned above, it is generally necessary to perform the grinding process in several steps, since it is not possible, for example, to easily remove a scratch or rough surface condition from the workpiece to be machined with a machining band having small-diameter diamond or corundum particles. In this case, a very long and therefore expensive machining time is required to make each machined workpiece. From one step to another, the grinding tool may also have to be changed in the machine tool, or the workpiece to be machined may also have been machined twice, which prolongs the machining time further and constitutes a drawback.

For example, when placing two tools in two working positions, it takes several seconds, for example 5 seconds, to move the workpiece from a first working position to a second working position. If only one working position is used, changing the tool for each machining step can take twice as long, for example 10 seconds, as two tools in two operating positions. The machining time for each workpiece is therefore long, which constitutes a drawback.

It should also be noted that, where two surfaces are to be machined or grounded, up to 6 tools may be needed for three machining steps per surface of the workpiece to be machined. The machining time of each workpiece made of hard material is therefore too long, given that the change from one working position to another working position or the repeated changing of tools considerably slows down the machining time, which constitutes a drawback. Further, there are limitations in machining positions available in the machine tools and in the tools available.

The tool may have at least one grinding surface or band composed of abrasive particles embedded in a binder. The abrasive particles are particularly diamond particles, or particles of equal or lower hardness than the workpiece to be machined, which may be made of a material such as sapphire, zirconia, oxides, nitrides or otherwise, for machining workpieces made of hard material, since wear of the abrasive part is too rapid.

Each machining band, which includes abrasive particles in a binder, can be fixed to a tool body by sintering, brazing or bonding, and the tool support body can be made of aluminium or steel, for example. The tool attachment shaft can be inserted into a tool spindle nose or chuck to perform the machining operation.

FIG. 1 schematically represents a machine tool 1. This machine tool 1 includes, in a conventional manner, a support part 2 carrying a first spindle 8 for a first machining tool 6, such as a first grinding wheel, and a second spindle 9 for a second machining tool 7, such as a second grinding wheel. A second part 4 of machine tool 1 includes a support block 3 for the workpiece 10 to be machined. Mainly, workpiece 10 can be mounted via an element 10' for holding a workpiece on a chuck 5 of support block 3.

Support part 2 can be moved in a first direction X, whereas support block 3 can be moved in a second direction Y perpendicular to first direction X and in a third direction Z perpendicular to first and second directions X and Y. Support block 3 can be rotated in a rotational direction A in the plane defined by first and second directions X and Y. Chuck 5 can be rotated during the machining of workpiece 10 in a direction of rotation C in the plane defined by second and third directions Y and Z.

During the machining of workpiece 10, the latter is first brought into contact with first grinding wheel 6, which can have a maximum diameter of 250 mm with a peripheral abrasive band having large-diameter diamond or corundum particles in a binder, for a rough grinding step. Next, the workpiece 10 to be machined must be brought into contact with second grinding wheel 7, which can also have a maximum diameter of 250 mm with a peripheral abrasive band having small-diameter diamond or corundum particles in a binder, for a finishing step.

As mentioned above, the time taken to perform these machining steps is relatively long, given that the workpiece must be moved from a first working position of first grinding wheel 6 to the second working position of second grinding wheel 7. This generally constitutes a workpiece grinding time that is too long and thus expensive at the end of the workpiece machining process. Further, the need to wait for one grinding wheel to finish rotating and then to start the other rotating results in long changeover times and requires additional energy to restart rotation, due to the inertia of the grinding wheel. These constitute drawbacks.

SUMMARY OF THE INVENTION

It is thus an object of the invention to propose a machining tool for performing a grinding operation on a workpiece in a machine tool to overcome the drawbacks of the aforementioned prior art and to reduce the machining time of each workpiece by the use thereof in a machine tool.

To this end, the invention concerns a machining tool for performing a grinding operation on a workpiece in a machine tool, which includes the features defined in the independent claim 1.

Specific embodiments of the machining tool are defined in the dependent claims.

One advantage of the machining tool lies in the fact that the tool includes several machining portions in the same tool. Each machining portion includes particles of a harder material than the workpiece to be machined which are embedded in a binder. The nature, size or diameter of the abrasive particles are different from one machining portion to another machining portion, and the concentration thereof in the binder can also be different. The first machining portion of the tool can include larger-diameter particles than the second machining portion in order to perform a rough machining step, and in order to use the second machining portion to perform a finish-grinding step on the workpiece.

More than two machining portions can be provided, each with abrasive particles of different diameter.

For machining workpieces made of hard material, such as for a sapphire watch glass or crystal, the abrasive particles are preferably diamond particles embedded in a binder.

Advantageously, the first and second machining portions are arranged in a same tool body in order to form a single one-piece tool to be mounted in a machine tool spindle to perform rough and finish-grinding operations. These machining portions are, for example, abrasive bands arranged on the same surface of the tool body and each forming a ring. The first annular abrasive band is coaxial to and preferably spaced apart from the second annular abrasive band. The first abrasive band is used for rough grinding and the second abrasive band, which is for example of smaller diameter, is used for finish-grinding the workpiece to be machined.

Advantageously, the grinding tool can include at least two parts which are attached to each other and can easily be disassembled in order to change one of the parts. A first part includes the first machining portion, whereas the second part includes the second machining portion. Since these parts are assembled and can be disassembled, in case of premature wear of one of the machining portions, it is possible simply to change the worn portion without having to completely change the tool.

It is also possible to have more than two complementary parts that can fit together like Russian dolls and are secured to each other to form the complete machining tool. Preferably, the last complementary secured part, which may be the first part with the first machining portion, is the part whose machining portion wears most quickly, such as during a rough machining step. This makes it easier to change this last complementary part of the tool.

BRIEF DESCRIPTION OF THE DRAWINGS

The objects, advantages and features of the machining tool for performing a grinding operation on a workpiece, particularly made of hard material, in a machine tool, will appear more clearly in the following description with reference to the drawings, in which:

FIGS. 3*a*, 3*b* and 3*c* represent diametral and top and bottom sectional views of the first and second parts having abrasive portions forming a second embodiment of the machining tool, and a three-dimensional exploded view of the tool with the various parts to be assembled according to the invention, FIGS. 4*a*, 4*b* and 4*c* represent diametral and top sectional views of the first and second parts having abrasive portions forming a first variant of the second embodiment of the machining tool, and a three-dimensional exploded view of the tool with the various parts to be assembled according to the invention, FIGS. 5*a*, 5*b* and 5*c* represent diametral and top sectional views of the first and second parts having abrasive portions forming a second variant of the second embodiment of the machining tool, and a three-dimensional exploded view of the tool with the various parts to be assembled according to the invention, FIGS. 7*a*, 7*b* and 7*c* represent diametral and top sectional views of the first and second parts having abrasive portions forming a second variant of a third embodiment of the machining tool and a three-dimensional exploded and assembled view of the tool to be fixed to a spindle chuck of a machine tool according to the invention, FIGS. 9*a*, 9*b* and 9*c* represent diametral and top sectional views of the first and second parts having abrasive portions forming a fourth variant of a third embodiment of the machining tool, and a three-dimensional exploded and assembled view of the machining tool to be fixed to a spindle chuck of a machine tool according to the invention.

DETAILED DESCRIPTION OF THE INVENTION

In the following description, the machining tool will be described as a grinding tool for grinding, for example, a surface of a workpiece to be machined, which is made of hard material. Preferably, the grinding tool is arranged, once mounted in a machine tool spindle, to be driven in rotation to make beveled edges, for example, on a workpiece, such as a watch glass or crystal, which may be made of sapphire, but without restriction to other machining possibilities.

Figure 2A:
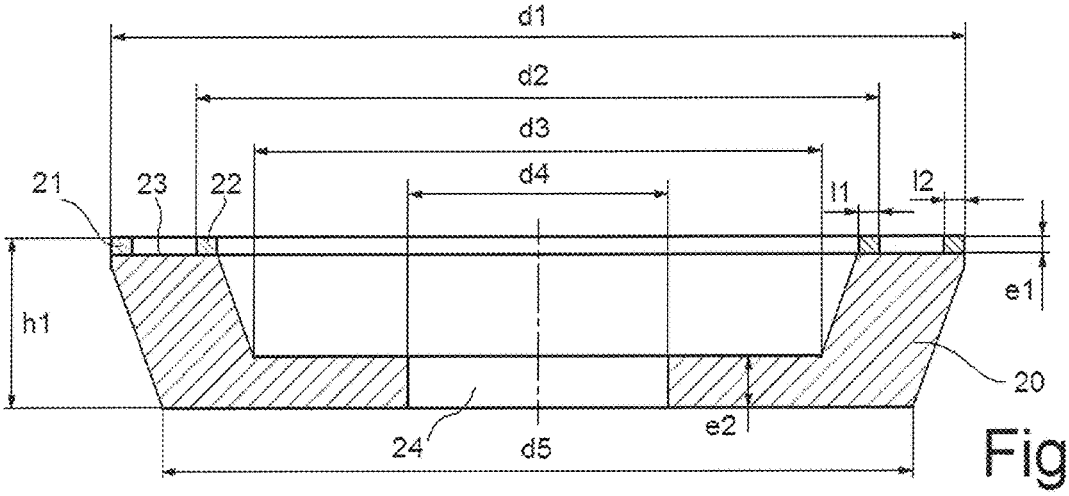
FIGS. 2*a* and 2*b* represent a diametral sectional view and a three dimensional view of a first embodiment of a one-piece machining tool with different abrasive bands on one face of the tool body according to the invention.
Figure 2B:
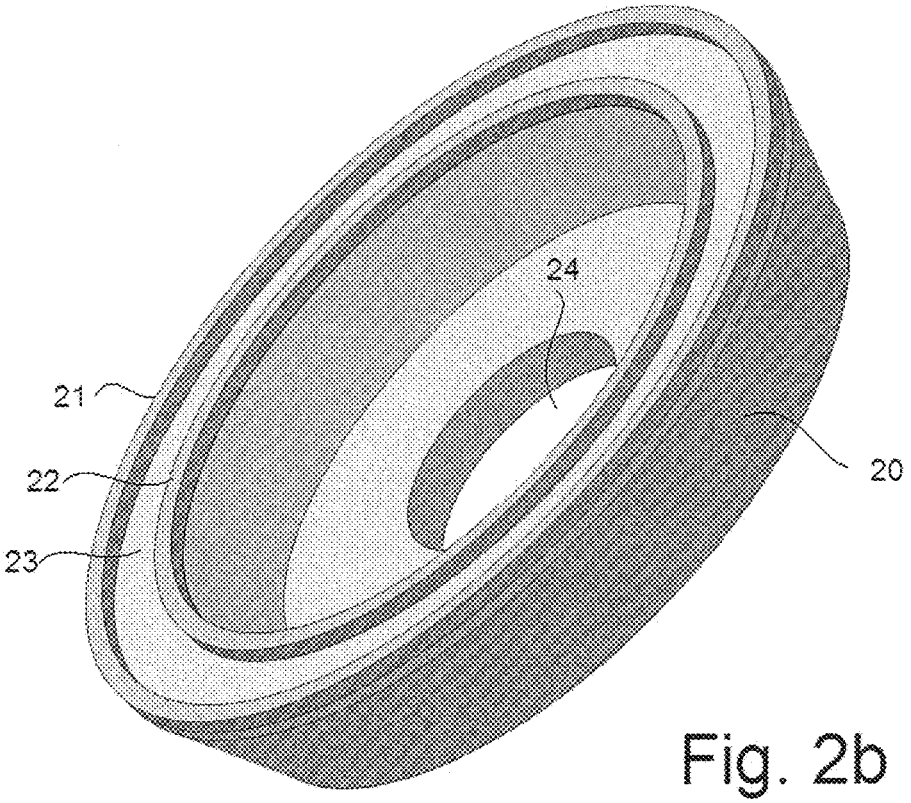

FIGS. 2*a* and 2*b* represent a machining tool 20 for a grinding operation on one or more workpieces to be machined. The machining tool is mainly used for grinding workpieces made of hard material. Machining tool 20 mainly includes at least a first machining portion 21, and at least a second machining portion 22. The first and second machining portions 21, 22 each include particles of a harder material than the material of each workpiece to be machined. These particles are arranged or embedded in a binder. The mean size or the mean diameter of the machining particles is different for each machining portion. This makes it possible to perform several machining operations or steps with the same machining tool 20 without having to change the tool in a machine tool for different machining steps.

To machine workpieces made of hard material, the various machining portions 21, 22 of machining tool 20 should preferably be made with diamond particles. It is also possible to envisage using corundum particles, but the machining portion wears more quickly with such corundum particle machining portions, since the hardness of this material is generally equal to or lower than that of the workpiece to be machined.

The diamond particles are embedded in a binder, which may be a metallic, resin, vitrified, galvanic, ceramic, bakelite or other binder. It is possible to envisage embedding the particles of machining portions 21, 22 in an identical or different binder. For each machining portion, the size or diameter of the diamond particles (grains) is defined by Dxx and the diamond concentration per $mm^3$ in its binder is defined by Cxx. By way of example, a mean grain size on the order of 91 μm corresponds to D91, and a diamond particle concentration of 100 grains per $mm^3$ corresponds to C100. For a machining step defined as rough machining, the particle size of one machining portion is larger than the particle size of another machining portion for a machining step defined as finish-machining. Thus, the smaller the grain size, the finer the machining operation.

The machining tool 20 shown in FIGS. 2*a* and 2*b* includes a first machining portion in the form of a first abrasive band or layer 21, and a second machining portion in the form of a second abrasive band or layer 22. These abrasive bands 21, 22 are secured to a face 23 of the base body of machining tool 20. Preferably, face 23 is a front face 23 forming a ring on which is secured each annular abrasive band 21, 22. These abrasive bands 21, 22 are fixed coaxially with respect to one another on front face 23 of cylindrical or conical tool body 20 to form a one-piece tool in this first embodiment. Preferably, front face 23 is perpendicular to the axis of rotation of cylindrical or conical tool body 20 when it is mounted in a machine tool spindle.

Tool base body 20 may be metallic, for example made of steel or aluminium. Abrasive bands 21, 22 are fixed to front face 23 by sintering, brazing or bonding. A space is provided between each abrasive band to allow a first machining step to be performed with first abrasive band 21 without detriment to second abrasive band 22 for a second machining step. First abrasive band 21 can be defined with a particle size of between D20 and D30 for a rough machining step, while second abrasive band 22 can be defined with a particle size of between D6 and D12, for example, for a finish-machining step. It is possible to use more than two machining portions, i.e. more than two abrasive bands, which can be arranged and spaced coaxially with respect to each other on the same front face 23 or another side face for example. Each band has a different size of abrasive particles.

By way of non-limiting example, the dimensions of a machining tool 20 shown in FIGS. 2*a* and 2*b* are indicated. The diameter d1 of the tool, as well as the external diameter of first abrasive band 21, can be 250 mm. The external diameter of second abrasive band 22 can be 200 mm. The width l1 of second abrasive band 22 can be 6 mm and the width l2 of the first abrasive band can be identical to 6 mm of first width l1 or different. Thus, the space between each abrasive band can be 19 mm. The thickness e1 of each abrasive band can be identical or different, but here this thickness e1 can be 5 mm.

The conical machining tool 20 can also include a shaft mounted by plates (not represented) through an opening 24 in the base of the base body of tool 20. The tool shaft can be mounted on a spindle chuck of a machine tool as shown, for example, in FIG. 1. The diameter d3 of the inner part of the base can be 166.2 mm. The diameter d4 of opening 24 can be 76 mm. The diameter d5 of the external part of the base can be 219.7 mm and the thickness e2 of the base can be 15 mm. The thickness or height h1 of the base body with abrasive bands 21, 22 can be 50 mm. Other dimensions can be determined for the same tool shape for example without limitation.

Figure 3B:
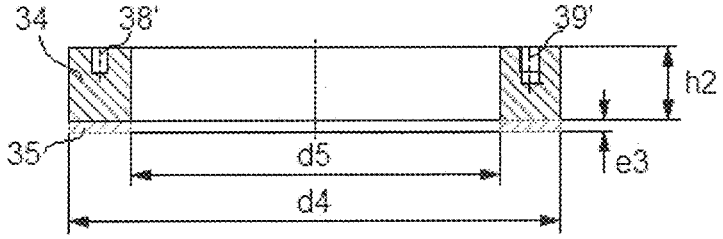
Figure 3C:
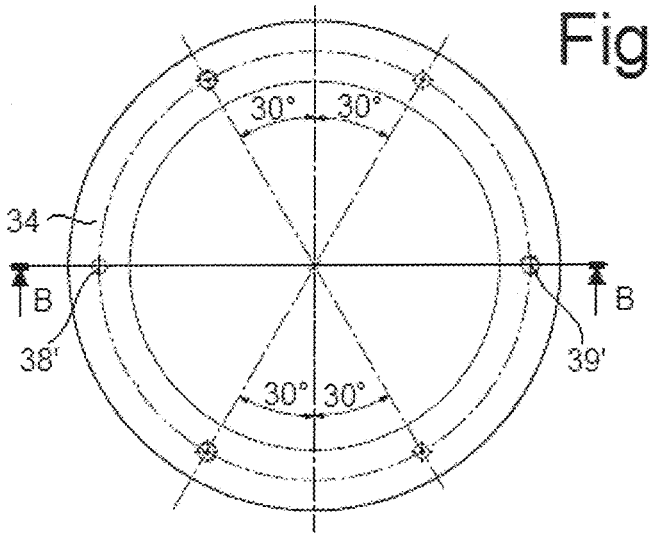
Figure 3C:
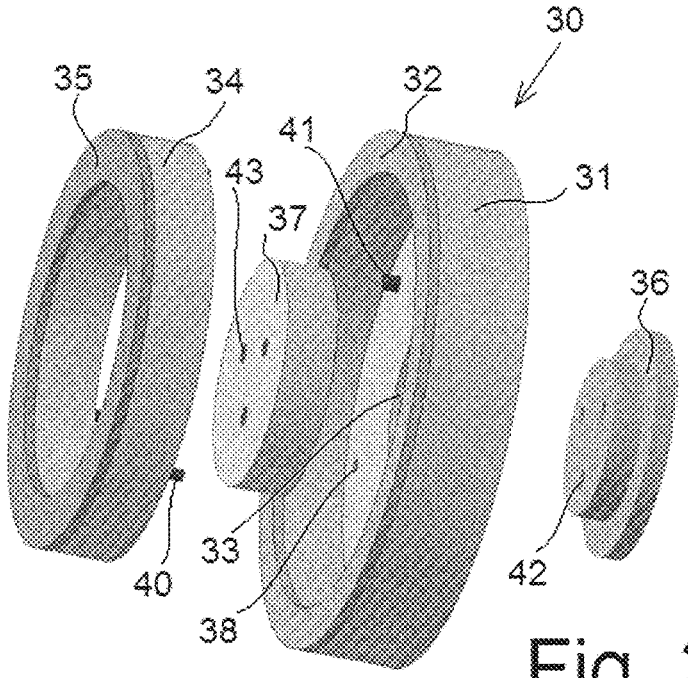

FIGS. 3*a*, 3*b* and 3*c* represent a second embodiment of machining tool 30. In this second embodiment, the machining tool is formed of various parts assembled or fitted together like Russian dolls.

This machining tool 30 has at least two parts 31, 34 which are secured to each other and can easily be disassembled in order to change one of the parts. A first part 31 includes a first machining portion 32, while second part 34 includes a second machining portion 35. The size or diameter of the abrasive particles, as previously, is different from one machining portion to another machining portion, and their concentration in the binder may also be different. Since these parts are assembled and can be disassembled, in case of greater wear of one of the machining portions, it is possible simply to change the worn portion without having to completely change the tool.

The first and second complementary parts 31, 34 are configured in a generally cylindrical shape, but may have another general shape provided that they can fit one inside the other, for example.

As represented in FIG. 3*a*, first part 31 is in the form of a cylindrical cup with a central opening 33 in the cup base for the attachment of second part 34 and the attachment of two holding plates normally connected to a machining tool shaft (not represented) for mounting in a machine tool spindle chuck. The axis of the cylindrical cup is arranged on an axis of rotation of the machining tool.

First part 31 includes a first machining portion 32, which is secured by sintering, brazing or bonding to a front edge of the base body of first part 31. The base body may be made of steel or aluminium for example. Preferably, this first machining portion 32 is a first abrasive band 32 of annular shape whose width may be identical to the width of the edge of first part 31. First abrasive band 32 may include particles, especially diamond particles, in a conventional binder.

In the cup base of first part 31, first holes 38 are made for positioning or attaching pins shown below with reference to FIG. 3*c*, in order to place the second part, which has equivalent holes on its periphery for the mounting thereof in the cup of first part 31. Second holes 39 are also provided in the cup base with an external recess for placement of screws for mounting second part 34, shown below with reference to FIG. 3*c*.

Three first holes 38 and three second holes 39 may be provided, arranged alternately on a same coaxial circle around opening 33 in the base. The angle separating a first hole 38 from an adjacent second hole 39 is thus 60°.

By way of non-limiting example, the external diameter d1 of the first part can be 250 mm, while the inner diameter d2 can be 210 mm. The width of the abrasive band is thus in this case around 20 mm and its thickness e1 can be 5 mm. The thickness e2 of the cup base can be 15 mm and its height h1 up to first abrasive band 32 can be 45 mm. The diameter d3 of the opening in the base can be 76 mm. The diameter of first holes 38 can be 6 mm and the diameter of second holes 39 for the passage of the threaded part of each screw can be 8.8 mm and the diameter for the screw head can be 14.5 mm. The first and second holes 38 and 39 are on a circle of 177 mm diameter.

As represented in FIG. 3*b*, second part 34 is configured in the form of a washer and has a second machining portion 35, which is preferably a second abrasive band 35 secured by sintering, brazing or bonding to an annular upper edge surface of the body of second part 34. Second abrasive band 35 can be of identical width to the width of the edge of washer 34. The body of second part 34 may be made of steel or aluminium for example.

First holes 38', identical to the first holes of the first part, are made on a portion of the height of washer 34 from a lower edge. Second threaded holes 39' for receiving the threaded part of mounting screws are also provided on a portion of the height of the washer from the lower edge. Three first holes 38' can therefore be provided, arranged alternately with three second threaded holes 39' arranged on a central circle on the lower edge of the washer. The angle between a first hole 38' and a second hole 39' is thus 60°. This circle is arranged halfway between the external diameter and the internal diameter of washer 34.

By way of non-limiting example, the external diameter d4 of second part 34 can be 202 mm, while the inner diameter d5 of second part 34 can be 152 mm. Holes 38' and 39' are on a circle of diameter of around 177 mm. The thickness e3 of second abrasive band 35 can be 5 mm. The height h2 of second part 34 up to the second abrasive band can be 30 mm. The depth of first holes 38' can be 10 mm and the depth of the threaded part of second holes 39' can be 10 mm with a non-threaded hole extension of 5 mm.

It should also be noted that second abrasive band 35 of second part 34 can be intended for a rough grinding step, while first abrasive band 32 of first part 31 can be intended for a finish-grinding step with a smaller particle size than that of second abrasive band 35.

FIG. 3*c* shows a three-dimensional exploded view of the various elements of machining tool 30 according to the second embodiment. The mounting of first and second parts 31 and 34 is achieved by means of screws 41, wherein the head of each screw is placed in the recess of each second hole 39 of the first part in order to be screwed into each second threaded hole of second part 34. Pins 40 are fixed in the first holes of second part 34 to be placed in the first holes 38 of first part 31.

An arrangement of a first circular plate 36, such as a stopper, and a second plate 37, such as a disc, can be provided for the mounting or attachment thereof through central opening 33 in the cup base of first part 31. First plate 36 thus includes a solid central cylindrical piece and a circular rim or shoulder. The central piece is of slightly smaller diameter than the diameter of opening 33 of first part 31. The central piece can pass through central opening 33 with the rim resting against the external surface of the cup base of first part 31. At least three mounting holes 42 can be provided in the central piece of first circular plate 36.

Figure 1:
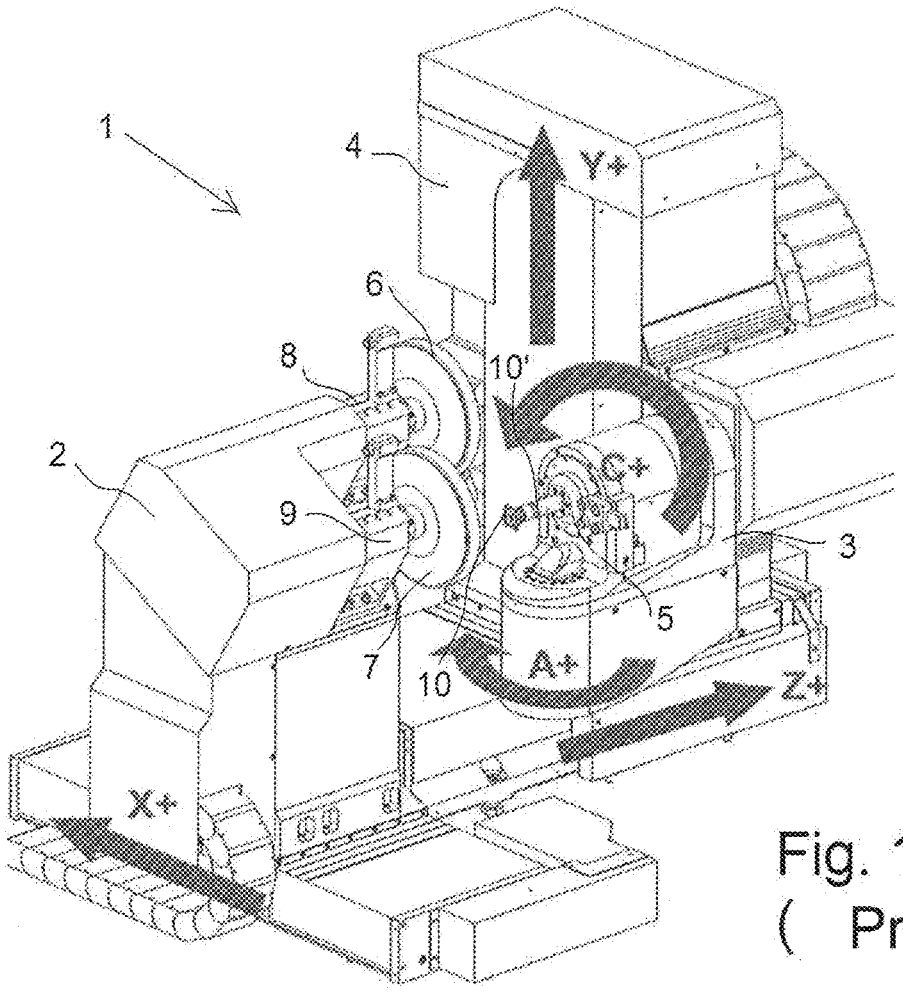
Fig. 1 ( Prior Art )
FIG. 1, already cited, represents a simplified view of a machine tool for performing grinding operations on a workpiece, particularly made of hard material, according to the prior art.

A second plate 37 of generally cylindrical shape, such as a disc, and of larger diameter than the diameter of central opening 33 is arranged to be secured on an inner side of the cup of first part 31 to the first plate. For this purpose, at least three mounting holes 43, for example through holes, are provided in second circular plate 37 in an identical arrangement to the three holes of first circular plate 36. Thus, the two plates can, for example, be secured by screws (not represented) that pass, for example, through the three holes of the first plate and are screwed into the three threaded holes of second plate 37, which, after attachment, rests against the inner surface of the cup base of first part 31. These two mounting plates 36, 37, made of aluminium or steel for example, are preferably connected to a shaft of machining tool 30 for mounting in a machine tool spindle chuck, as represented in FIG. 1.

By way of variant of the second embodiment, it is possible to envisage having a second cup-shaped part 34 with a second machining portion 35, such as a second abrasive band placed on a front face or edge of second cup-shaped part 34. A solid base is provided at the bottom of the cup for this second part 34. A central opening for passage of a mounting screw shaft can be made in the cup base of second part 34 and a screw head recess can also be provided inside the cup of the second part. A central threaded hole can be made in first plate 36 to receive the threaded portion of the mounting screw. Second part 34 is directly secured with its cup base in the cup base of first part 31 by tightening a screw, which passes through the screw hole of the second part, into the threaded hole of first plate 36 whose central portion is inserted into opening 33 of first part 31. Thus, second plate 37 is no longer necessary, and there are no first holes and second holes made in first part 31 and second part 34.

Of course, in a variant of the machining tool, second part 34 can also be directly secured by means of a screw in the cup base of first part 31 without opening 33 and without first plate 36, but with a central threaded hole in the base of first part 31.

It should also be noted that the second part 34 shown in FIG. 3*b* can be a washer without first holes 38' and second holes 39'. This second part 34 can be secured to first part 31 by means of an external thread on a lower external area of second part 34 opposite the point of attachment of second abrasive band 35 to the front face of second part 34. In such case, an inner cylindrical edge complementary to the external thread of second part 34 at the bottom of the cup of first part 31 can be provided. Second part 34 is attached by being screwed into the internal thread of the inner cylindrical edge of first part 31. Of course, the thread is made in an opposite direction to the rotation of the tool during machining in order to hold the two parts 31 and 34 securely fixed to each other.

First and second abrasive bands 32, 35 were explained above as preferably being secured to a front edge or face of each part 31, 34. However, they could also be secured to an external or internal side wall of the cup or washer-shaped first and second parts 31, 34. The same applies for the embodiments described below. Each abrasive band could also be arranged on a front face and partly continuously secured to the side walls of the cup of each part. This type of abrasive band is in the form of an annular cup.

Figure 4B:
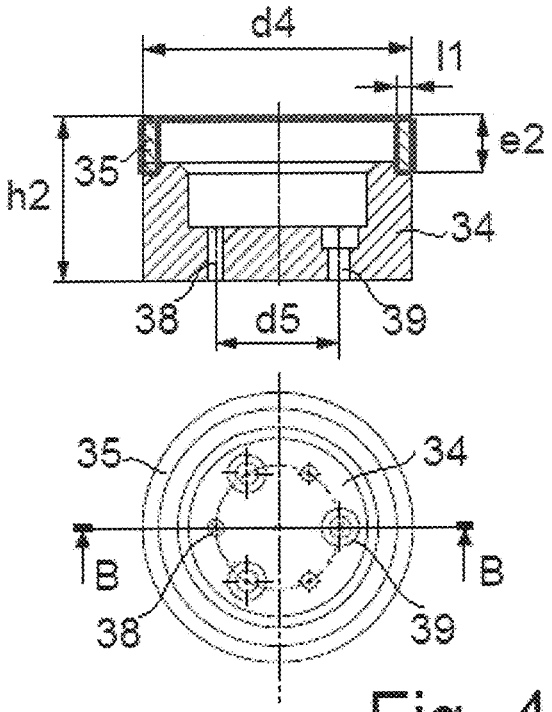
Figure 4C:
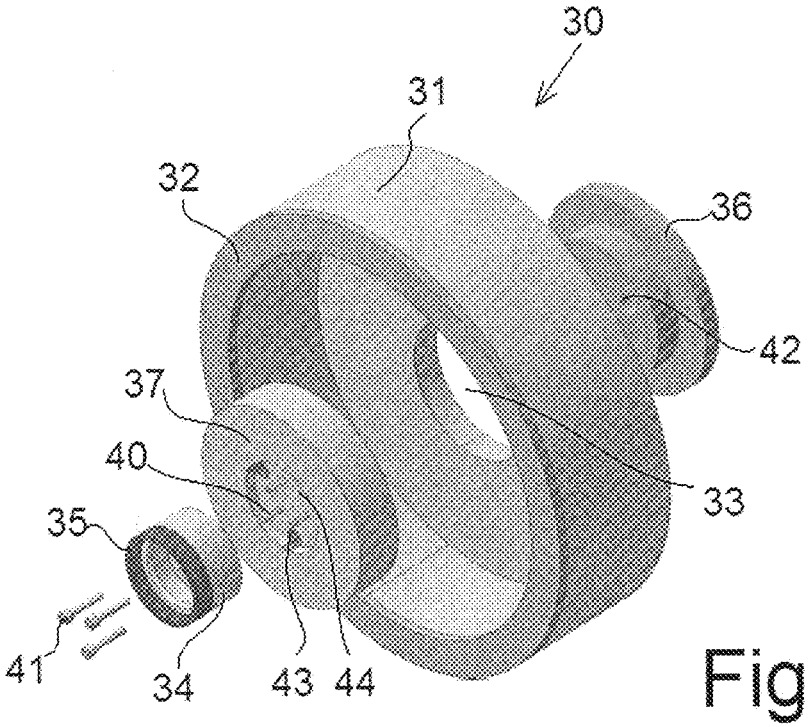

FIGS. 4*a*, 4*b* and 4*c* represent a first variant of the second embodiment shown in FIGS. 3*a*, 3*b* and 3*c*. The same reference signs are used for the same elements of this first variant and, for the sake of simplification, only those elements that differ from the embodiment presented in FIGS. 3*a*, 3*b* and 3*c* will be described.

FIG. 4*a* represents first part 31 with first machining portion 32 in the form of a first abrasive band 32. This first part 31 is identical in shape to the first part 31 described with reference to FIG. 3*a*. This first part 31 includes only a central opening 33, but there is no mounting hole in the cup base. The dimensions of this first part 31 may be the same as those of the first part 31 seen in FIG. 3*a*. However, it is only height h1 of first part 31 up to first abrasive band 32, which may be greater, for example, than 74 mm.

FIG. 4*b* represents second part 34 with a second machining portion 35 in the form of a second annular abrasive band 35 of larger thickness than width. This second abrasive band is cylindrical in shape. Second abrasive band 35 is secured to the external periphery of the edge of second part 34. This second part 34 is cup-shaped. In the cup base of second part 34, first holes 38 are made for positioning or attaching pins shown below with reference to FIG. 4*c*, in order to place this second part 34 on a second mounting plate explained below. Second holes 39 are also arranged in the cup base with an inner recess for placement of screws for mounting this second part 34 on the second plate explained below in FIG. 4*c*.

Three first holes 38 and three second holes 39 can be provided in the cup base of second part 34, arranged alternately on the same coaxial circle. The angle separating a first hole 38 from an adjacent second hole 39 is thus 60°.

By way of non-limiting example, external diameter d4 of second abrasive band 35 can be 50 mm. The thickness of second abrasive band 35 can be 8 mm, while the width l1 of second abrasive band 35 can be 3 mm. The height h2 of second part 34 with second abrasive band 35 can be 30 mm. The diameter d5 of the placement circle of holes 38 and 39 can be 23 mm. The diameter of each first hole 38 can be 3 mm and the diameter of second hole 39 for passage of the threaded part of each mounting screw can be 4 mm, while the diameter of the screw head recess can be 7 mm. This screw head recess of each second hole is inside the cup of the second part.

FIG. 4*c* shows a three-dimensional exploded view of the various elements of machining tool 30 according to the first variant of the second embodiment. This time, second part 34 is mounted and secured to a second mounting plate 37 of generally cylindrical shape and not to first part 31.

As in the embodiment shown in FIG. 3*c*, a first circular mounting plate 36 in the form of a stopper includes a solid cylindrical central piece and a circular rim or shoulder. The central piece is of slightly smaller diameter than the diameter of opening 33 of first part 31. The central piece can pass through central opening 33 and the rim rests against the external surface of the cup base of first part 31. As previously, at least three mounting holes 42 can be provided in the central piece of first circular plate 36.

A second plate 37 of generally cylindrical shape and of larger diameter than the diameter of central opening 33 is arranged to be secured on an inner side of the cup of first part 31 to first plate 36. For this purpose, at least three mounting holes 43, for example through holes, are arranged in second circular plate 37 to face the three holes of first circular plate 36. The two plates can, for example, be secured by screws (not represented) that pass through the three holes 42 of first plate 36 and are screwed into the three threaded holes 43 of second plate 37, which rests, after attachment, against the inner surface of the cup base of first part 31. These two mounting plates 36, 37 are, for example, made of aluminium or steel and can be connected to a shaft of machining tool 30 for mounting in a machine tool spindle chuck, as represented in FIG. 1.

The second part 34 is secured to second plate 37 by being housed inside a cavity of complementary shape arranged from an upper surface of second plate 37. Pins 40, mounted in holes provided for this purpose in the cavity of second plate 37, are housed in the first holes through the cup base of second part 34 when this second part 34 is attached to second plate 37. Three screws 41 are also arranged to pass through the second holes of second part 34 to be screwed into three corresponding threaded holes 44 in the cavity of second plate 37. Once this second part 34 is secured in the cavity of second plate 37, second abrasive band 35 is situated outside said cavity and more at the centre of the machining tool yet quite separate from first abrasive band 32 of first part 31. The top of second abrasive band 35 can be at the same height as the top of first abrasive band 32 after assembly and before machining.

It is also to be noted that this second abrasive band 35 of second part 34 can be intended for a rough grinding step, while first abrasive band 32 of first part 31 can be intended for a finish-grinding step with a smaller particle size than that of second abrasive band 35.

As described above with reference to a variant of the second embodiment of FIGS. 3*a*, 3*b* and 3*c*, it is possible to envisage having a second cup-shaped part 34 with a second machining portion 35, such as a second abrasive band placed on a front face or edge of cup-shaped second part 34. A solid base is provided at the bottom of the cup for this second part 34, which can be fixed by means of screws in a central threaded hole made in first plate 36. Second part 34 is directly secured with its cup base in the cup base of first part 31 by tightening a screw in the threaded hole of first plate 36 whose central part is inserted in opening 33 of first part 31. Thus, second plate 37 is no longer necessary, and there are no first holes and second holes made in first part 31 and second part 34.

As previously, second part 34 can also be secured directly by means of a screw in the cup base of first part 31 without opening 33 and without first plate 36, but with a central threaded hole in the base of first part 31.

Figure 5B:
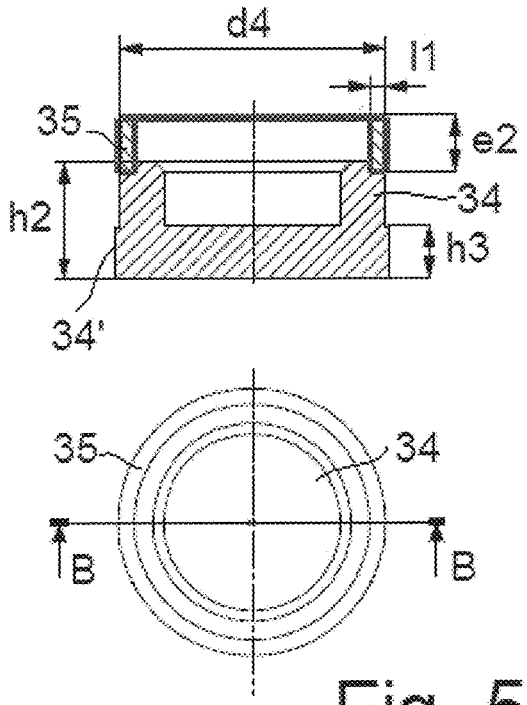
Figure 5C:
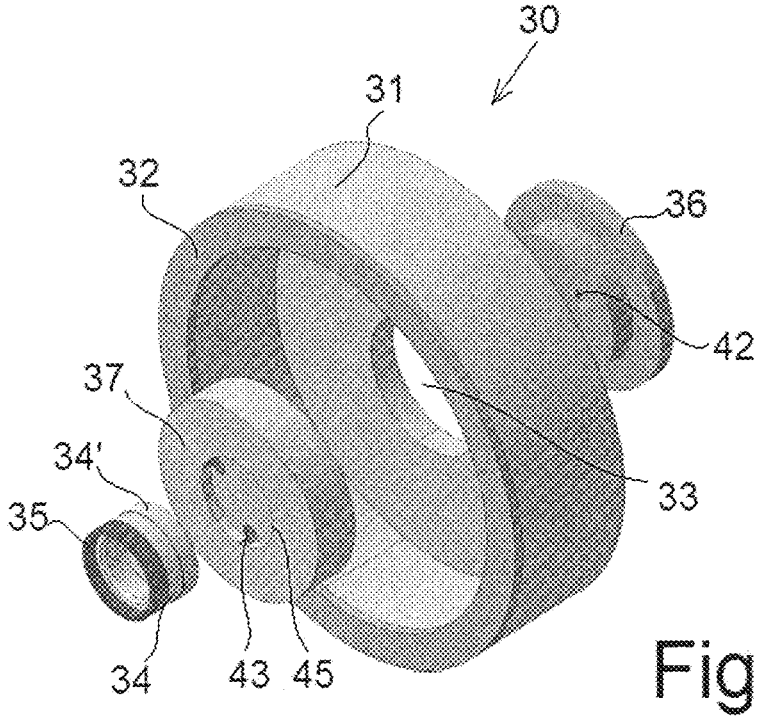

FIGS. 5*a*, 5*b* and 5*c* represent a second variant of the second embodiment shown in FIGS. 3*a*, 3*b* and 3*c*. This second variant is largely similar to the first variant described with reference to FIGS. 4*a*, 4*b* and 4*c*. For the sake of simplification, only those elements that differ from the first variant will be described.

First part 31 of FIG. 5*a* is entirely identical to that described in FIG. 4*a*. Likewise, second part 34 of FIG. 5*b* is of identical shape to that of FIG. 4*b*, except that there are no means provided, such as holes in the cup base, for attachment to a second plate described below. The difference lies in the fact that there is an external thread 34' on an external area of the base body of second part 34. This thread 34' is disposed on a side opposite to the position of second abrasive band 35. By way of non-limiting example, the height h3 of this thread 34' can be 10 mm high.

FIG. 5*c* represents a three-dimensional exploded view of the various elements of machining tool 30 according to the second variant of the second embodiment. Second part 34 is mounted inside a complementary-shaped cavity of second mounting plate 37, which is of generally cylindrical shape. The cavity includes a thread 45 for screwing in and attaching second part 34 with its thread 34'. The orientation of the thread is arranged to be in an opposite direction to rotation of the machining tool for grinding operations in a machine tool spindle. In this manner, second part 34 remains properly screwed into the threaded cavity 45 of second plate 37. There are only holes 43 in the second plate for attachment to first plate 36 by means of screws passing through holes 42 of first plate 36. Machining tool 30 can also include a shaft fixed to first plate 36 for mounting inside a spindle chuck of the machine tool.

Figure 6A:
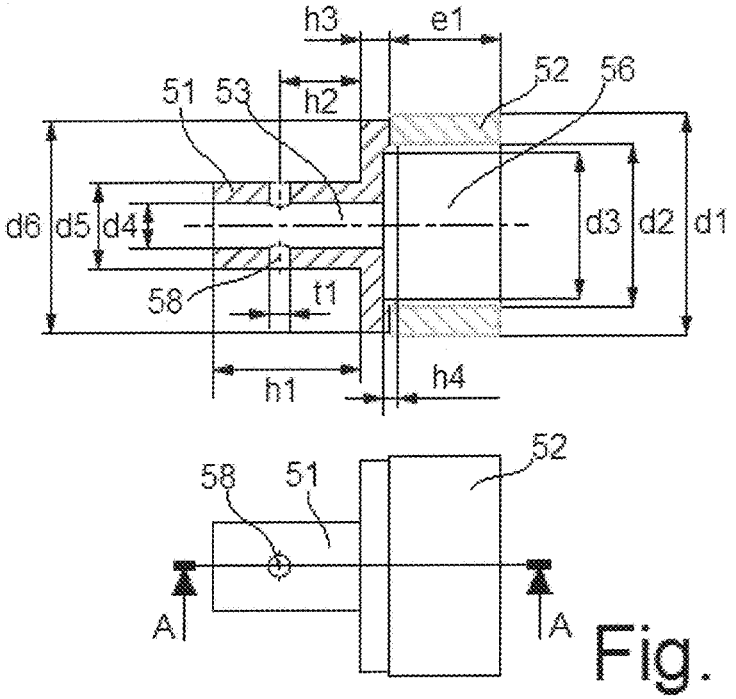
FIGS. 6*a*, 6*b* and 6*c* represent diametral and top sectional views of the first and second parts having abrasive portions forming a first variant of a third embodiment of the machining tool, and a three-dimensional exploded and assembled view of the tool to be fixed to a spindle chuck of a machine tool according to the invention.
Figure 6B:
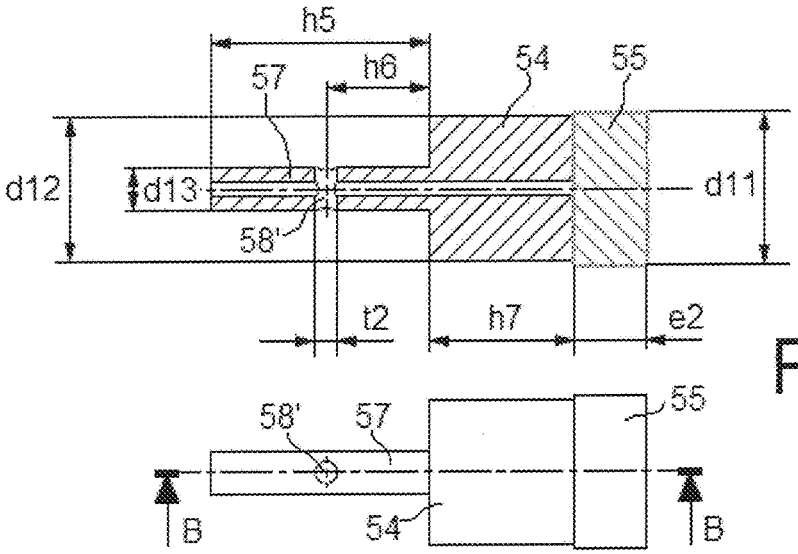
Figure 6C:
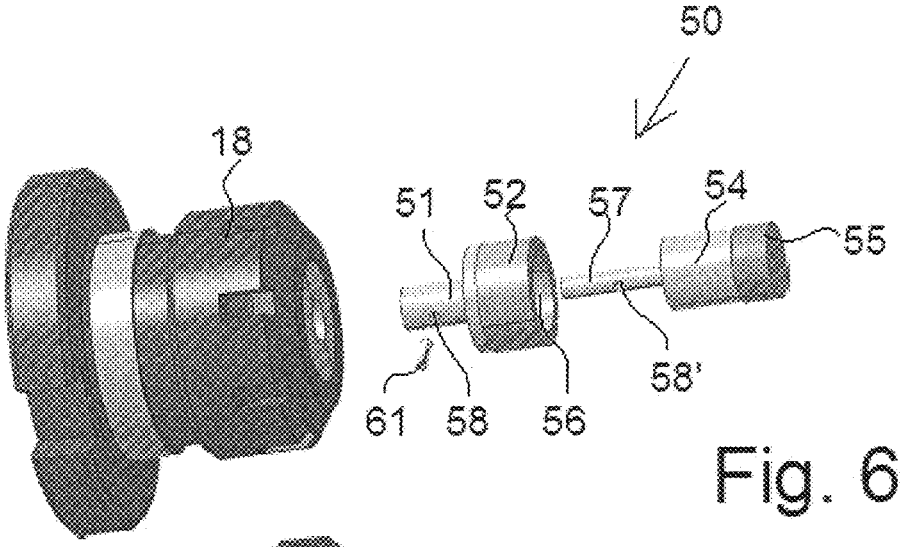

FIGS. 6*a*, 6*b* and 6*c* represent a first variant of a third embodiment of machining tool 50. In this third embodiment, the machining tool is formed of at least two different parts assembled or fitted together like Russian dolls.

As represented in FIG. 6*a*, first part 51 includes a first machining portion 52, which may be in the form of a first abrasive band arranged and secured by sintering, brazing or bonding on an upper edge of a cup shape. First abrasive band 52 is cylindrical to extend the cup-shape of first part 51 with a thickness e1 that is larger than its width. The cup with first machining portion 52 includes a recess 56 for receiving the second part of the machining tool. The cup also includes an opening 53 of diameter d4 through its base with a lower tubular extension from opening 53 of the base and disposed along a longitudinal axis of the cup. The external diameter d5 of the tubular extension is smaller than the external diameter d1 of the cup with first machining portion 52. This tubular extension of first part 51 further includes a first through opening 58 perpendicular to the central axis of the tubular extension for a means of attachment in the form of a pin, a key, a conical peg or a screw, for example.

As represented in FIG. 6*b*, second part 54 includes a second machining portion 55 in an upper position of second part 54. This second machining portion 55 is in the form of a solid cylindrical abrasive block 55, forming a tool head, having a flat upper surface and having a lower surface secured, particularly by sintering, brazing or bonding, to a flat upper surface of a cylindrical body of second part 54. The external diameter d12 of this cylindrical body of second part 54 is identical to or slightly smaller than external diameter d11 of solid cylindrical abrasive block 55. A cylindrical extension 57 extends along a central axis from a lower surface of the cylindrical body of second part 54. This cylindrical extension 57, and possibly the cylindrical body, can have a centred longitudinal opening. A second through opening 58' is also provided in cylindrical extension 57, which is perpendicular to the central axis of the tubular extension. This second through opening 58' is arranged to be aligned with the first through opening of the first part once the second part 54 is fitted inside the first part. The two parts can be secured by a pin or a key or a conical peg or a screw inserted into the two aligned through openings, for example.

By way of non-limiting example of first and second parts 51 and 54 of FIGS. 6*a* and 6*b*, the external diameter d1 of first abrasive band 52 can be 30 mm, while the external diameter d6 of the cup body can be 29 mm. The inner diameter d2 of first abrasive band 52 can be 22 mm, which gives an abrasive band width of 4 mm and a thickness e1 of 15 mm. The inner diameter d3 of the cup base can be 20 mm. The diameter d4 of opening 53 in the cup base can be 6 mm. The external diameter d5 of the tubular extension of the first part can be 12 mm. The length h1 of the tubular extension can be 20 mm with the first through opening 58 having a diameter t1 of around 3 mm. This through opening 58 is located at a distance h2 of 11 mm from the external surface of the cup base. The abrasive band is secured at a height h2 of around 4 mm, while an inner edge from the cup base is at a height h4 of 2 mm. The external diameter d11 of cylindrical abrasive block 55 of second part 54 can be 21 mm and its thickness e2 equal to 10 mm for example, while the upper body of second part 54 has an external diameter d12, which can be 20 mm. The external diameter d13 of cylindrical extension 57 can be around 6 mm in order to be inserted into opening 53 of the first part and to slide into the opening of the tubular extension of first part 51. The length h5 of the extension can be 30 mm. The second through opening 58' can have a diameter t2 of 3 mm and be at a distance h6 of 14 mm from the cylindrical body of second part 54, which has a height h7 of around 20 mm.

FIG. 6*c* represents a three-dimensional exploded and assembled view of machining tool 50 before and after mounting on a chuck 18 of a machine tool spindle. Second part 54 with its cylindrical extension 57 is inserted into housing 56 of first part 51, and cylindrical extension 57 passes through the central opening in the cup base to slide into the opening of the tubular extension of first part 51. Once the two openings 58 and 58' are properly aligned, a pin 61 or possible a screw is inserted, for example forcibly, and wedged inside the two openings, which means that machining tool 50 is completely assembled and ready for machining operations.

It should also be noted that first machining portion 52 of first part 51 can be used for a rough grinding step, while second machining portion 55 of second part 54 can be used for a finishing step.

Figure 7A:
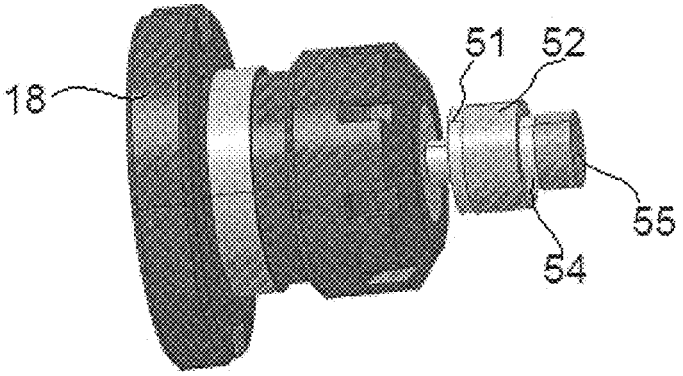
Figure 7A:
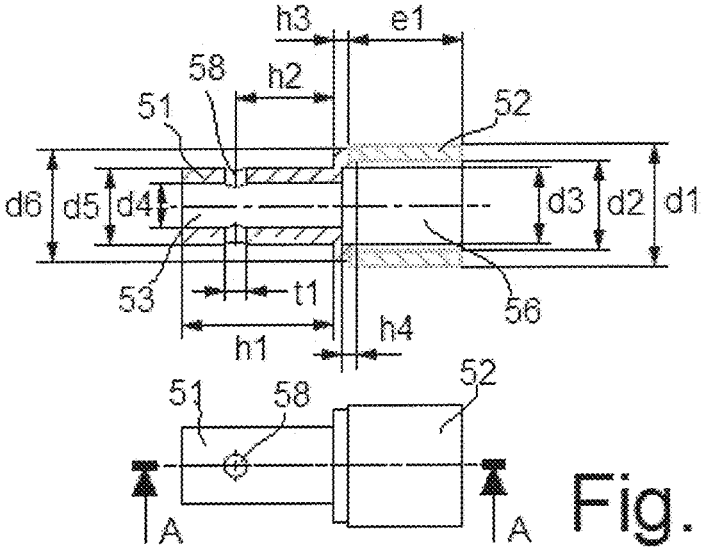

FIGS. 7*a*, 7*b* and 7*c* represent a second variant of a third embodiment of machining tool 50. As previously, in this second variant of the third embodiment, the machining tool is also formed of at least two different parts assembled or fitted together like Russian dolls. All the elements of this second variant are identical to those of the first variant described with reference to FIGS. 6*a*, 6*b* and 6*c*. Consequently, the identical parts and the assembly thereof will not all be described. There is simply a dimensional difference in first and second parts 51 and 54.

By way of non-limiting example of first part 51 of FIG. 7*a*, diameter d1 can be 30 mm, diameter d2 can be 12 mm, diameter d3 can be 10 mm, diameter d4 can be 6 mm, diameter d5 can be 10 mm and diameter d6 can be 15 mm. Thickness e1 can be 15 mm. Length h1 can be 20 mm, distance h2 can be 13 mm, height h3 can be 2 mm and height h4 can be 2 mm. The diameter t1 of first through opening 58 can be 3 mm.

By way of non-limiting example of second part 54 of FIG. 7*b*, diameter d11 can be 11 mm and thickness e2 equal to 10 mm, diameter d12 can be 10 mm, and diameter d13 can be 6 mm, or slightly less to allow cylindrical extension 57 of second part 54 to slide into the tube of the tubular extension of first part 51. The length h5 of the extension can be 30 mm. The second through opening 58' can have a diameter t2 of 3 mm and be at a distance h6 of 14 mm from the cylindrical body of second part 54, which has a height h7 of around 20 mm.

Figure 8A:
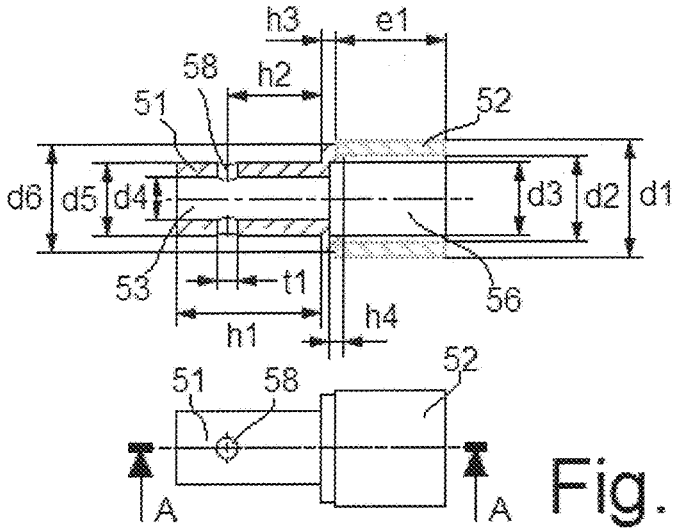
FIGS. 8*a*, 8*b* and 8*c* represent diametral and top sectional views of the first and second parts having abrasive portions forming a third variant of a third embodiment of the machining tool, and a three-dimensional exploded and assembled view of the machining tool to be fixed to a spindle chuck of a machine tool according to the invention.
Figure 8B:
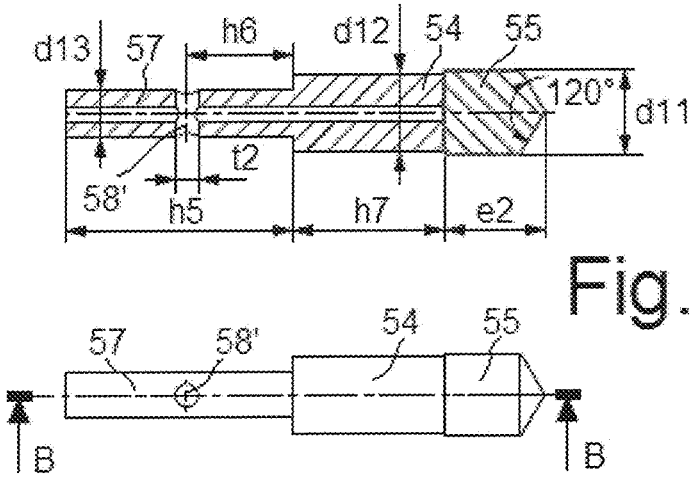
Figure 8C:
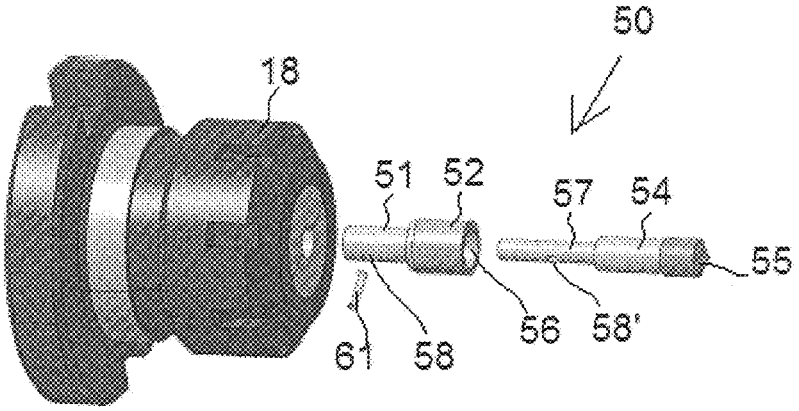

FIGS. 8*a*, 8*b* and 8*c* represent a third variant of a third embodiment of machining tool 50. For this third variant of the third embodiment, machining tool 50 is also formed of at least two different parts assembled or fitted together like Russian dolls. Machining tool 50 of this third variant is identical even in dimensions to the various elements described for the second variant of FIGS. 7*a*, 7*b* and 7*c*. The only difference concerns second machining portion 55 secured to a flat surface of the cylindrical body of second part 54. This second machining portion 55 does not end in a flat surface, but in a centred tip, whose tip angle can be 120°.

Figure 9A:
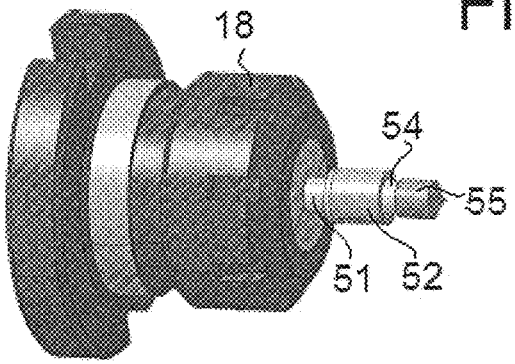
Figure 9A:
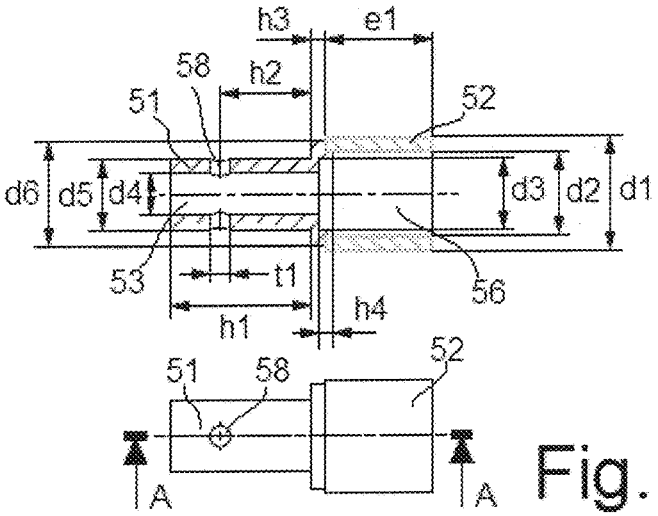

FIGS. 9*a*, 9*b* and 9*c* represent a fourth variant of a third embodiment of machining tool 50. For this fourth variant of the third embodiment, machining tool 50 is also formed of at least two different parts assembled or fitted together like Russian dolls. This fourth variant is identical even in dimensions to the various elements described for the second variant of FIGS. 7*a*, 7*b* and 7*c*. The only difference concerns second machining portion 55 secured to a flat surface of the cylindrical body of second part 54. This second machining portion 55 does not end in a flat surface, but in a semi-spherical shape, whose radius may be half the diameter of solid cylindrical abrasive block 55, i.e. 5.5 mm.

It should also be noted that first machining portion 52 of first part 51 can be used for a rough grinding step, while second machining portion 55 of second part 54 can be used for a finishing step. This type of machining tool 50 can advantageously be used to make bevelled edges on workpieces and particularly bevelled edges for watch glasses or crystals, which may be made of sapphire, or for workpieces made of ceramic, zirconia, oxides or nitrides.

It should also be noted that instead of attaching first and second parts 51 and 54 once assembled via a pin or a key or a screw, it is possible to envisage making an inner thread in the tubular extension of first part 51 and an outer thread on cylindrical extension 57 of second part 54. Thus, second part 54 is secured to first part 51 by screwing its threaded cylindrical extension into the complementary thread of the tubular extension of first part 51.

Figure 10A:
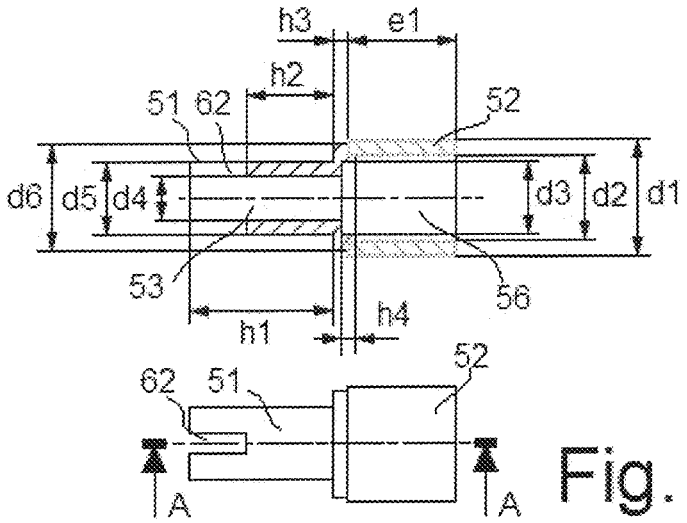
FIGS. 10*a*, 10*b* and 10*c* represent diametral and top sectional views of the first and second parts having abrasive portions forming a fifth variant of a third embodiment of the machining tool, and a three-dimensional exploded and assembled view of the machining tool to be fixed to a spindle chuck of a machine tool according to the invention.
Figure 10B:
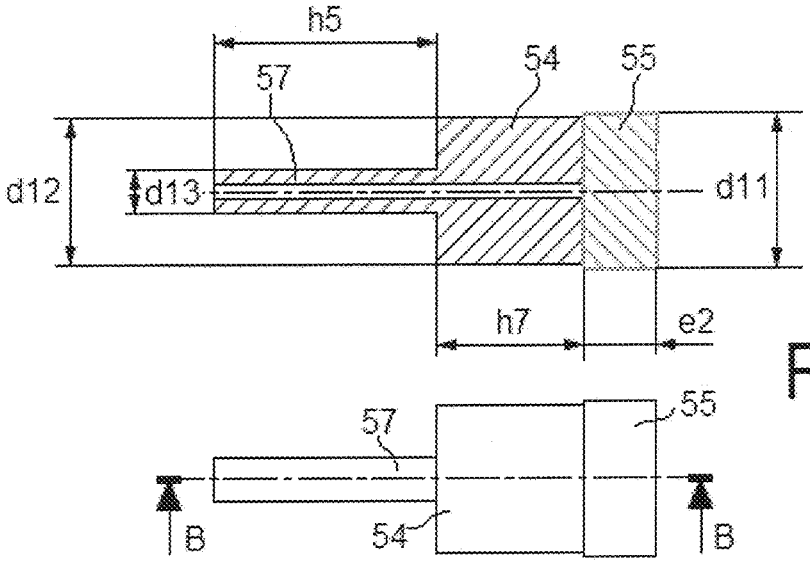
Figure 10C:
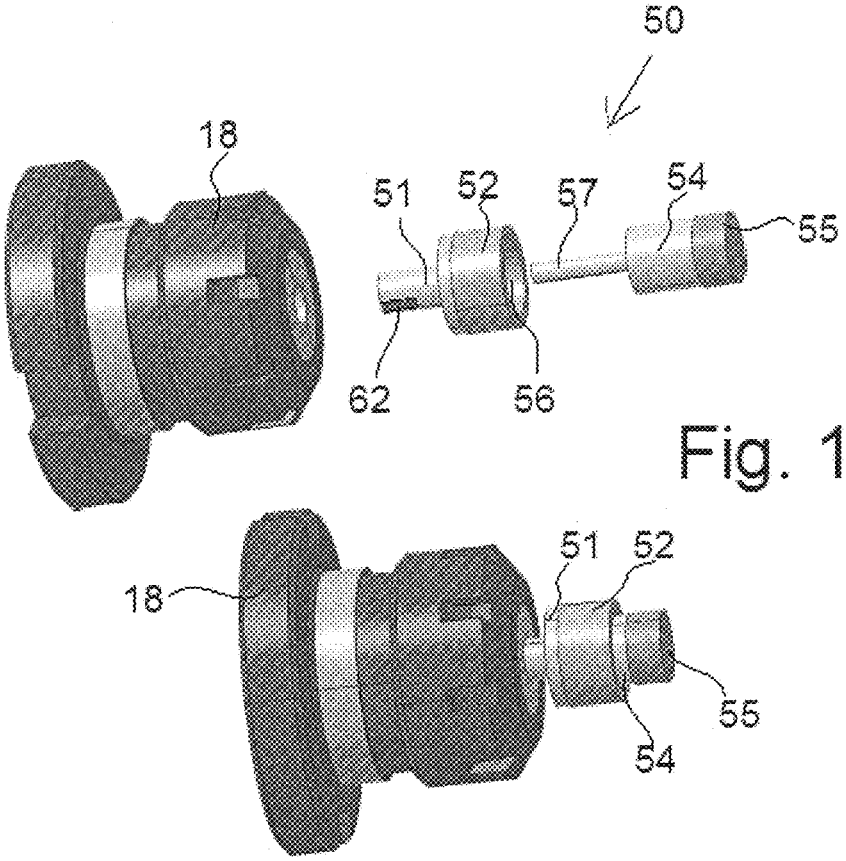

FIGS. 10*a*, 10*b* and 10*c* represent a fifth variant of a third embodiment of machining tool 50, which is based on the first variant shown in FIGS. 6*a*, 6*b* and 6*c*. For the sake of simplification, only the difference of this fifth variant with respect to the first variant is explained.

The difference of this fifth variant is the means of securing first part 51 and second part 54. Thus, instead of through holes 58, 58' in the tubular and cylindrical extensions of the first and second parts 51, 54 shown in FIGS. 6*a* and 6*b*, there is only a slot 62 made at the end of the tubular extension of first part 51. This slot 62 is preferably made on two diametrically and axially opposite sides. This slot can be located at a distance h2 of 11 mm from the external surface of the cup base. Thus, cylindrical extension 57 of second part 54 is inserted into the tube of the tubular extension of first part 51 until the base body of the second part is in the cup base of first part 51. Retention of second part 54 and first part 51 is obtained once tool 50 is inserted into chuck 18. The clamping of the chuck folds the slotted portion of the first part and secures second part 54 inside first part 51 by this clamping force.

It is to be noted that slot 62 can be longer and extend as far as the base of the cup of first part 51. This type of attachment is simpler than the attachment means described above and makes it possible to quickly change a tool part having a worn machining portion once the tool is removed from the machine tool chuck.

Naturally, it is possible to envisage having more than two machining portions for each machining tool, for example at least three machining portions, both for a one-piece tool as described with reference to FIGS. 2*a* and 2*b*, and for a tool with various parts assembled or fitted together which can be disassembled. Each machining portion preferably includes diamond particles whose size or diameter is different from one machining portion to another machining portion in the same tool. It is thus possible to envisage placing these machining portions in the form of bands or layers at the periphery of a cylindrical or conical tool body at a sufficient distance from each other. With three machining portions, a rough grinding step can be performed, followed by a semi-finish grinding step, and finally a finish-grinding step.

In the case of a machining tool with various assembled parts, the part with a worn machining portion can be changed while keeping the other parts whose machining portion is not yet too worn, since the parts can be disassembled with no difficulty.

From the description that has just been given, several variants of the machining tool can be devised by those skilled in the art without departing from the scope of the invention defined by the claims.

The invention claimed is:

1. A machining tool for grinding a workpiece in a machine tool, comprising:

at least a first machining portion having particles of a harder material than the material of the workpiece to be machined, the particles being arranged in a binder; and at least a second machining portion having particles of larger or smaller diameter than the first machining portion, and of a harder material than the material of the workpiece to be machined, the particles of the second machining portion being arranged in an identical binder to that of the first machining portion or in a different binder, wherein the first and second machining portions are annular bands continuously formed around a circumference of a same tool body, wherein said first and second machining portions are formed by first and second abrasive bands, each of the first and second abrasive bands are arranged on top of a same planar front outer face of the tool body, wherein a width of the first abrasive band in a direction along the top of the planar front outer face of the tool body is a same width as the second abrasive band along the top of the planar front outer face of the tool body, and wherein a thickness of the first abrasive band from the planar front outer face of the tool body to a height of the first abrasive band is different from a thickness of the second abrasive band from the planar front outer face of the tool body to a height of the second abrasive band.

2. The machining tool for grinding a workpiece made of hard material in a machine tool according to claim 1, wherein each machining portion comprises diamond particles embedded in the binder.

3. The machining tool according to claim 1, wherein said first and second machining portions are placed on the same tool body to form a one-piece tool.

4. The machining tool according to claim 3, wherein the tool is capable of being driven in rotation in a spindle of the machine tool to grind the workpiece to be machined.

5. The machining tool according to claim 4, wherein a third machining portion in the form of a third abrasive band is arranged on the face of the same tool body.

6. The machining tool according to claim 5, wherein said third annular band is secured to the front face coaxially to the first and second abrasive bands which are all spaced apart from each other.

7. The machining tool according to claim 1, wherein said first and second abrasive bands are spaced apart from each other, and wherein the front face is perpendicular to an axis of rotation of the cylindrical or conical tool body, wherein the tool body is cylindrical or conical in shape.

* * * * *